US005374040A

United States Patent [19]

Lin

[11] Patent Number: 5,374,040

[45] Date of Patent: Dec. 20, 1994

[54] VISE WITH INTERCHANGEABLE DOUBLE CLAMPING SEAT OR SINGLE CLAMPING SEAT

[76] Inventor: Philip Lin, No. 537-8, Chung-San Rd., Ching-Shui Chen, Taichung Shien,

[21] Appl. No.: 151,734

[22] Filed: Nov. 15, 1993

[51] Int. Cl.[5] ..... B25B 1/20

[52] U.S. Cl. ..... 269/43; 269/154; 269/242

[58] Field of Search ..... 269/43, 136, 138, 153, 269/154, 242, 906

[56] References Cited

U.S. PATENT DOCUMENTS 4,934,674 6/1990 Bernstein ..... 269/136

*Primary Examiner*—Robert C. Watson

*Attorney, Agent, or Firm*—Browdy and Neimark

[57] ABSTRACT

A vise comprises a main seat, two movable jaws, two transmission blocks, a control rod, and a fixing jaw mounted detachably on the main seat to form together with the two movable jaws the double clamping seat. The control rod is provided with a tolerance compensating device comprising: a sleeve fitted over the control rod and fastened to the main seat; two end thrust members mounted on the control rod and located at both ends of the sleeve; and at least one elastic element located between the sleeve and the control rod for providing a resistance preventing the control rod to move axially. The double clamping seat can be converted into the single clamping seat by removing the fixing jaw from the main seat. The tolerance compensating device and the control rod are provided therebetween a fastening device regulating the control rod to turn without moving axially.

9 Claims, 5 Drawing Sheets

VISE WITH INTERCHANGEABLE DOUBLE CLAMPING SEAT OR SINGLE CLAMPING SEAT

FIELD OF THE INVENTION

The present invention relates generally to a vise, and more particularly to a vise provided interchangeably with double clamping means or single clamping means.

BACKGROUND OF THE INVENTION

As disclosed in the U.S. Pat. No. 4,529,183, a prior art vise capable of holding two work pieces simultaneously is provided With a threaded rod movable in the longitudinal direction, a movable jaw fastened with the rear end of the threaded rod, and another movable jaw fitted over the smooth portion of the threaded rod such that the movable jaw can be caused to move with the threaded rod along the longitudinal direction, and that the threaded rod can be caused to turn. In operation, one movable jaw can be caused to clamp one work piece first by rotating the threaded rod. Thereafter, another movable jaw is caused to hold another work piece by a reaction force of the first movable jaw, which actuates the movement of the threaded rod along with the second movable jaw. The operation of such prior art vise comprises two steps and is therefore relatively inefficient. Another prior art vise disclosed in the U.S. Pat. No. 4,685,663 comprises two movable jaws coupled respectively with two concentric threaded rods. The two movable jaws are driven separately. Such a vise as described above has a complicated construction and is therefore difficult to operate. In addition, these two prior art vises are defective in design in that they can not locate concentrically the clamped work piece at the time when they are used as a vise with single clamping seat.

SUMMARY OF THE INVENTION

It is, therefore, the primary objective of the present invention to provide a vise with interchangeable dual clamping seat and single clamping seat, which enable the vise to hold firmly two work pieces simultaneously and the work pieces having dimension tolerance.

A further objective of the present invention is to provide a vise with interchangeable dual clamping seat and single clamping seat, which is capable of locating and holding a work piece concentrically with speed.

The foregoing objectives of the present invention are attained by a vise with interchangeable double clamping seat or single clamping seat. The vise comprises a main seat, two movable jaws, two transmission blocks, a control rod, a fixing jaw, a locking block, a locking element, and a tolerance compensating device. The main seat of rectangular construction is provided centrally in the top thereof with a slot of an inverted T-shaped construction. The two movable jaws are disposed on the main seat. The two transmission blocks are coupled respectively with the two movable jaws such that they are suspended in the slot of the main seat. The two transmission blocks are provided concentrically and respectively with a threaded hole. The two threaded holes of the two transmission blocks are identical in thread pitch and are opposite to each other in threading direction. The control rod is provided with two threaded segments by means of which the control rod engages the two threaded holes of the two transmission blocks. In addition, the control rod is disposed in the slot of the main seat such that one end of the control rod extends out of the main seat for a predetermined distance and is capable of turning so as to drive the two movable jaws to move in opposite directions synchronously. The fixing jaw is mounted detachably on the top of the main seat to form two clamping seats in conjunction with the two movable jaws. The present invention is characterized in that one end of the control rod, which extends out of the main seat for a predetermined distance, is provided with a tolerance compensating device which is composed of a sleeve fitting over the one end of the control rod, two end thrust members which are fitted over the control rod and located at both open ends of the sleeve, and at least one elastic element disposed between the sleeve and the control rod for providing a resistance preventing the control rod from moving axially.

The present invention is further characterized in that the fixing jaw of the present invention can be dismounted so that the present invention can be used as a vise with single clamping seat, and that the present invention is provided with a fastening device disposed between the tolerance compensating device and the control rod so as to cause the control rod to turn without being able to move axially. As a result, the vise of the present invention is capable of locating and clamping a work piece concentrically with speed.

DETAILED DESCRIPTION OF THE INVENTION

Figure 1:
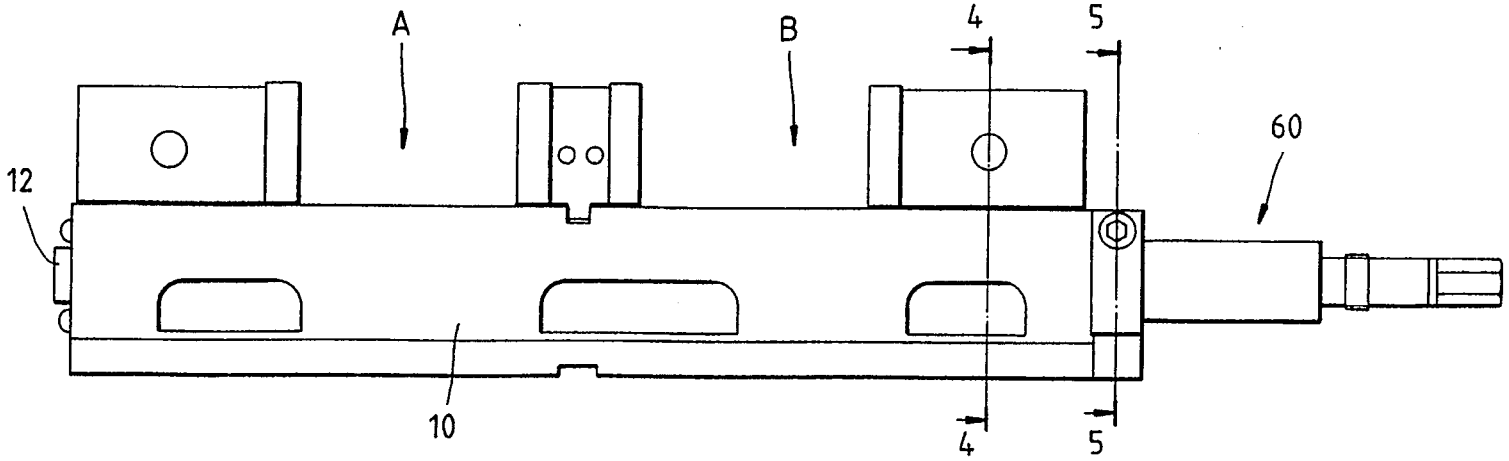
FIG. 1 shows a front elevational view of a first preferred embodiment of the present invention with double clamping seat.
Figure 2:
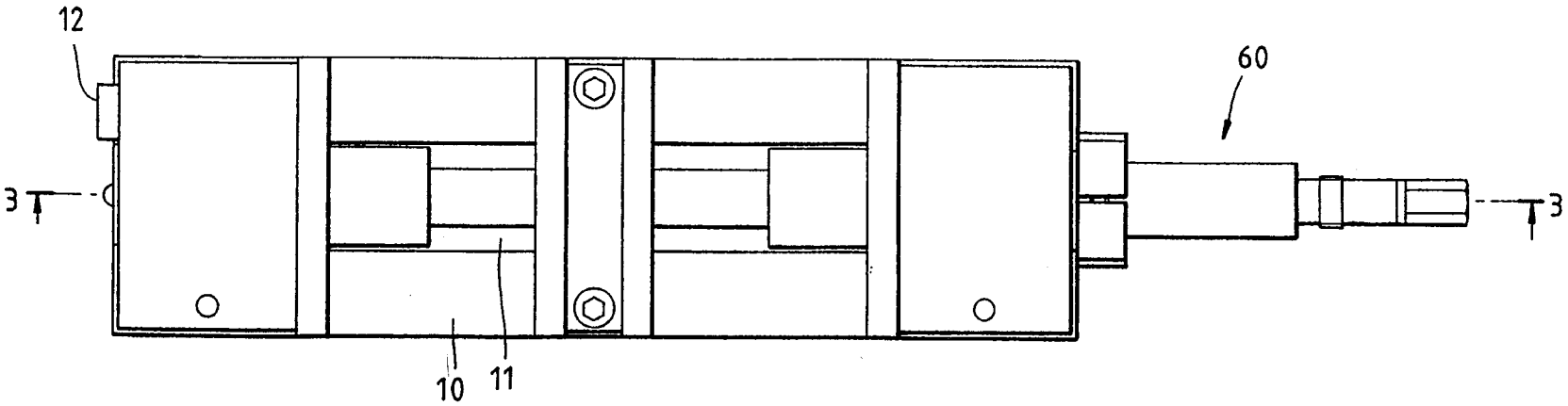
FIG. 2 shows a top plan view of the first preferred embodiment of the present invention as shown in FIG. 1.
Figure 3:
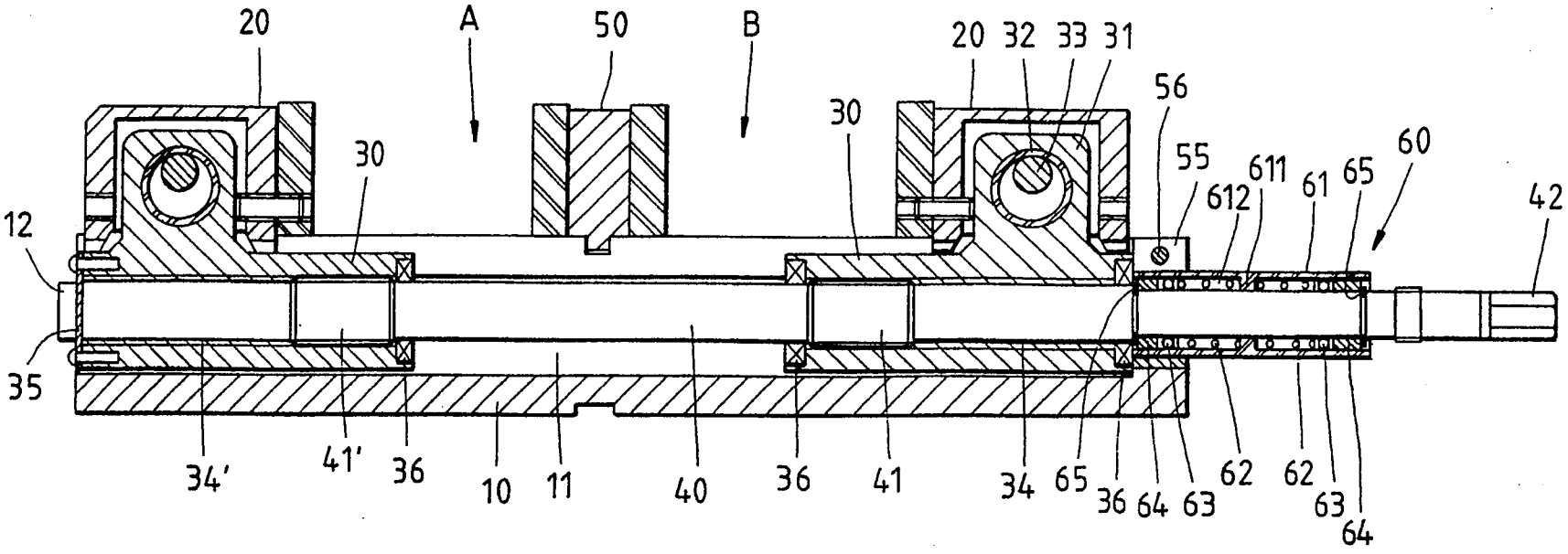
FIG. 3 shows a sectional view of a portion taken along the line 3—3 as shown in FIG. 2.

As shown in FIGS. 1–7, a vise embodied in the first preferred embodiment of the present invention has double clamping seat in action and comprises the components, which are described respectively hereinafter.

A main seat 10 of rectangular construction is provided centrally in the top thereof with a slot 11 of an inverted T shape.

Two movable jaws 20 are disposed on the top of the main seat 10.

Two transmission blocks 30 are coupled respectively with the two movable jaws 20 such that the two transmission blocks 30 are suspended in the slot 11. The transmission blocks 30 may be similar in construction to the slanted and semispherical transmission block as disclosed in the U.S. Pat. Nos. 4,529,183, 4,685,663 and 2,880,638, or the transmission blocks as disclosed in the U.S. Pat. No. 5,160,127 granted to the inventor of the present invention. The transmission blocks 30 of the present invention are similar in construction to those of the U.S. Patent mentioned last. The transmission blocks 30 are provided respectively with a connection portion 31 furnished with a bushing 32 and a shaft pin 33. For more details, please refer to the specification of the U.S. Pat. No. 5,160,127. The two transmission blocks 30 are provided concentrically with the threaded holes 34 and 34', which are identical in thread pitch and are opposite to each other in threading direction.

The control rod 40 is provided in the predetermined positions thereof with two threaded segments 41 and 41' which engage the two threaded holes 34 and 34' of the two transmission blocks 30. In addition, the control rod 40 is received in the slot 11 of the main seat 10 such that a predetermined length of one end of the control rod 40 extends out of the main seat 10. The one end of the control rod 40 is provided with a hexagonal connection portion 42 intended to couple with a handle (not shown in the drawings.) The handle is used in turning the control rod 40, which in turn drive the two transmission blocks 30 to actuate the two movable jaws 20 to move synchronously in opposite directions.

The fixing jaw 50 is detachably mounted on the top of the main seat 10 so as to form two clamping seats A and B in conjunction with the two movable jaws 20.

Figure 5:
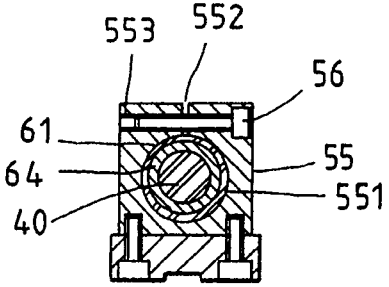
FIG. 5 shows a sectional view of a portion taken along the line 5—5 as shown in FIG. 1.
Figure 4:
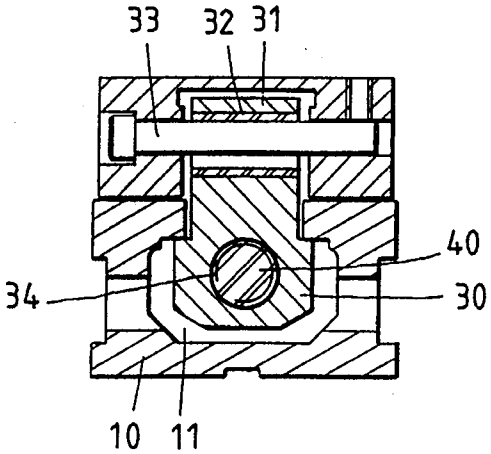
FIG. 4 shows a sectional view of a portion taken along the line 4—4 as shown in FIG. 1.

As shown in FIG. 5, the locking block 55 is provided centrally with a through hole 551, and with an indentation 552 in one side thereof. The indentation 552 passes through the through hole 551. The locking block 55 is further provided with a threaded hole 553 perpendicular to the indentation 552. The locking block 55 is fastened to one end of the slot 11 of the main seat 10.

The locking element 56 is in fact a bolt engaging the threaded hole 553 so as to force the indentation 552 of the locking block 55 to become narrower in order to cause the through hole 551 to become narrow to bring about a clamping effect.

The tolerance compensating device 60 mounted on the one end of the control rod 40 is composed of the components described hereinafter.

A sleeve 61 has an inner wall surface provided centrally with a protruded arresting portion 611. The sleeve 61 is received in the through hole 551 of the locking block 55 such that the sleeve 61 is concentric with the control rod 40 and that the position of the sleeve 61 can be adjusted in the direction of longitudinal axis of the through hole 551. The one end of the control rod 40 is put through the axial hole 612 of the sleeve 61.

Two elastic elements 62 are two springs, which are fitted over the control rod 40 and are fitted into the sleeve 61 such that they urge the arresting portion 611 of the sleeve 61.

Two thrust bearings 63 are fitted over the control rod 40 and are fitted into the sleeve 61.

Two end thrust members 64 are fitted over the control rod 40 and are fitted into the sleeve 61 such that the two end thrust members 64 are located respectively outside the two thrust bearings 63, and that the two end thrust members 64 are located respectively by means of a C-shaped retaining ring 65.

In addition, the threaded hole 34' of one transmission block 30 is provided at one end thereof with a cover plate 35. The inside of the threaded hole 34' and both ends of another threaded hole 34 are provided respectively with a dust shield 36 serving to prevent the dust from entering the threaded holes 34 and 34'. The main seat 10 is provided in one end thereof with an arresting block 12 serving to prevent the transmission blocks 30 from moving out of the slot 11 of the main seat 10.

The vise of the first preferred embodiment of the present invention is provided with two clamping seats A and B, which are capable of holding firmly two work pieces identical in shape and dimension or two work pieces different in shape and dimension. In operation, the locking block 55 must be loosened first so that the movable jaws 20, the transmission blocks 30, the control rod 40, the sleeve 61, and all members contained in the sleeve 61 can be moved in unison, and that the control rod 40 is moved axially. As a result, the dimension of the clamping seats A and B can be adjusted rapidly. Upon the completion of such an adjustment of the dimension of the clamping seats A and B, the locking block 55 is locked securely so that the clamping seats A and B are ready to work to hold firmly two work pieces having the same shape and dimension. By following the method described above, the dimension of the clamping seats A and B can be so adjusted as to hold firmly two work pieces differing in shape and dimension.

The action of the tolerance compensating device 60 is explained hereinafter. The same working principles are involved in two situations in which two work pieces of identical shape and dimension and two work pieces of different shapes and dimensions are to be held by the clamping seats A and B.

Figure 6:
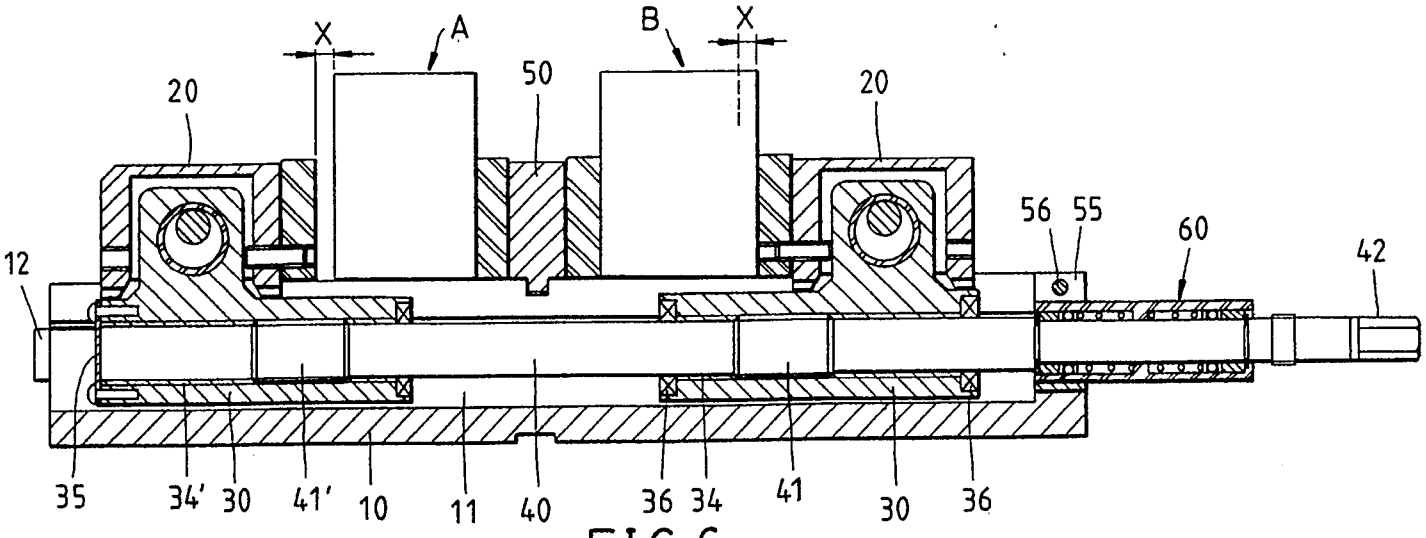
FIGS. 6 and 7 are schematic views illustrating the working of the present invention, with the double clamping seat in action.
Figure 7:
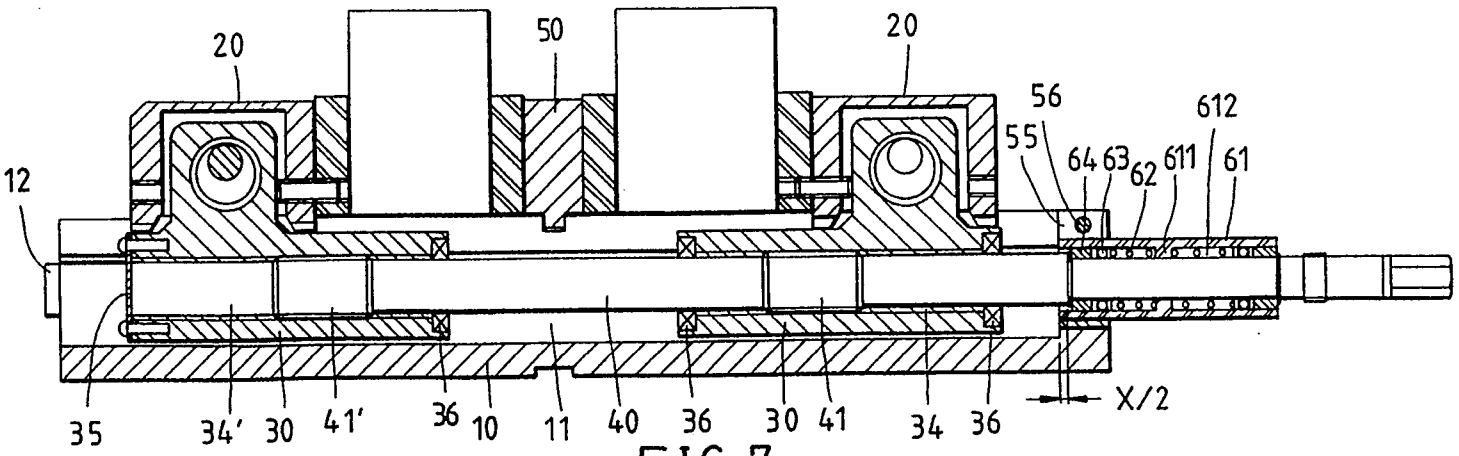

As shown in FIG. 6, the work piece held by the clamping seat A is assumed to be without an allowable error while another work piece held by the clamping seat B is assumed to have +X error. In operation, the work piece having the error is first held firmly by the clamping seat B. As a result, there is an X gap between the work piece and the jaw of the clamping seat A. The control rod 40 is then turned continuously so that the reaction force of the clamping seat B forces the control rod 40, the transmission blocks 30 and the movable jaws 20 to move synchronously toward the right side of the drawing by a distance of X/2, as shown in FIG. 7. The elastic element 62 located in the left side of the sleeve 61 is compressed by the end thrust member 64. The sleeve 61 is located securely on the main seat 10 by the locking block 55. As the compressed elastic element 62 is provided with a recovering force enabling it to spring back into shape, the two work pieces are therefore held and located securely. Upon the completion of the finishing work of the work pieces, the fixing jaw 50 is let loose so as to cause the bouncing force of the compressed elastic element 62 to force the control rod 40, the movable jaws 20 and the transmission blocks 30 to return to their original positions. The example described above is a common occurrence. A relatively extreme case involves one clamped work piece with an error of −X and another clamped work piece with an error of +X. The errors of both clamped work pieces are within an allowable range; nevertheless the combined errors of both clamped work pieces are so large that the both work pieces can not be possibly held firmly by the clamping seats A and B without the tolerance compensating device 60.

Figure 8:
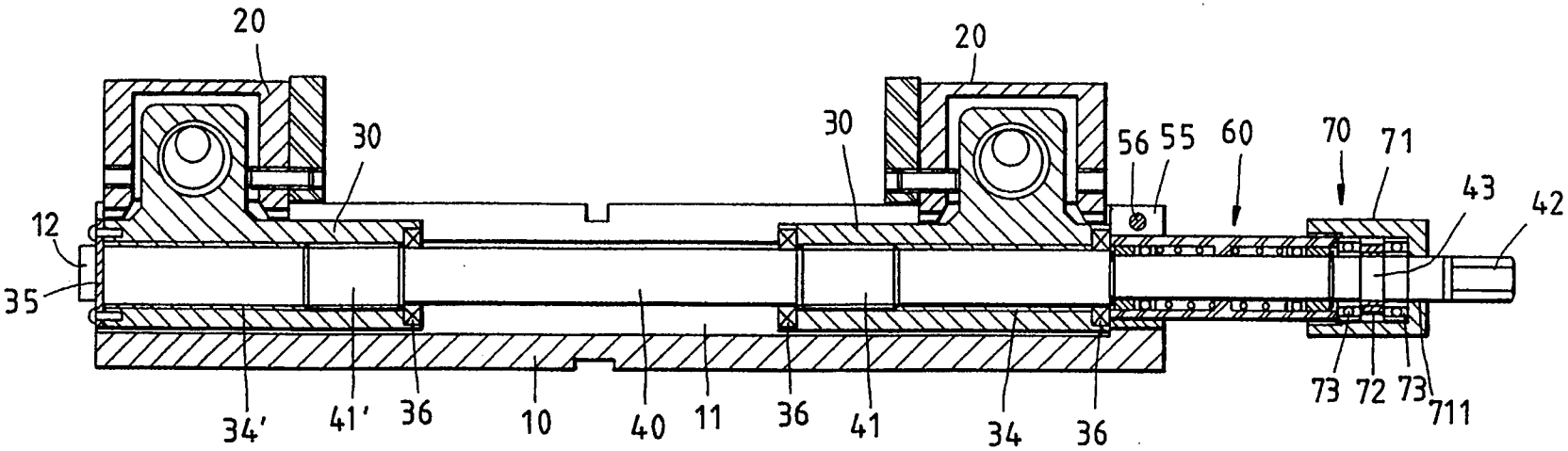
FIG. 8 is similar to FIG. 3 and is shown to comprise single clamping seat.
Figure 9:
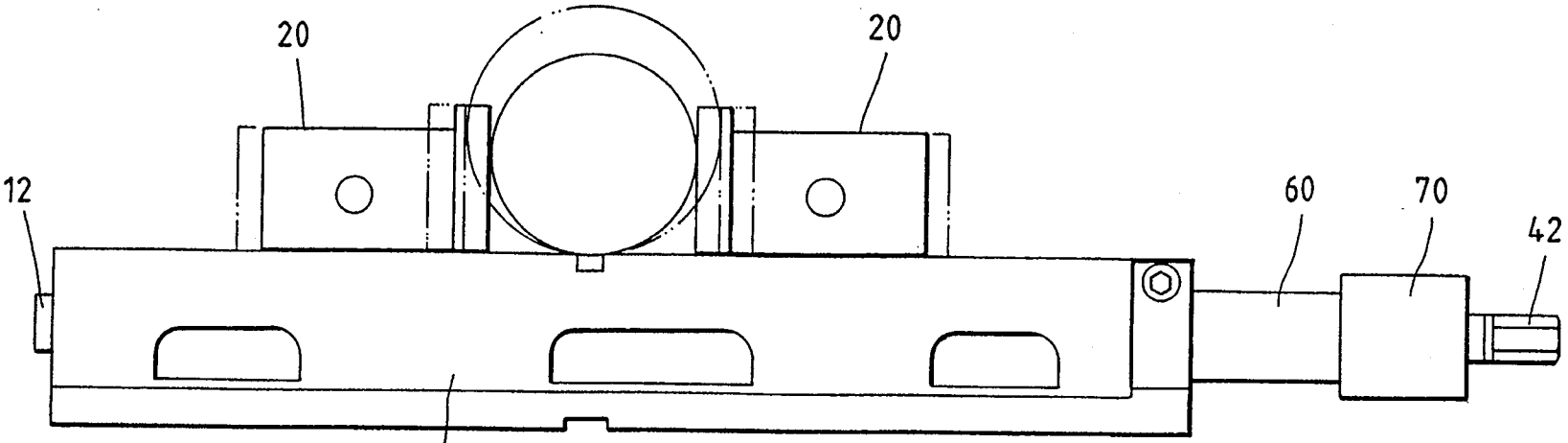
FIG. 9 is a schematic view illustrating the single clamping seat of FIG. 8 in action.

As shown in FIGS. 8 and 9, the vise of the present invention described above can be so converted that it is provided with single clamping seat. Such a conversion is made possible by dismounting the fixing jaw 50 and disposing a fastening device 70 between the control rod 40 and the tolerance compensating device 60. As a result, the control rod 40 can be caused to turn, without being able to move axially.

The fastening device 70 comprises the components described hereinafter.

A fastening sleeve 71 has one end fastened to the outer end wall of the sleeve 61 and another end having a hole 711 through which the control rod 40 is disposed.

A locating member 72, which is a nut, engages the threaded portion 43 of the control rod 40. In addition, the locating member 72 is disposed in the fastening sleeve 71 without making contact with the fastening sleeve 71.

Two thrust bearings 73 are respectively fitted over the control rod 40 such that the two thrust bearings 73 are adjacent to the locating member 72 and inside the fastening sleeve 71. In combination, one of the two thrust bearings 73 is first fitted over the control rod 40 before the locating member 72 (a nut) is engaged with the threaded portion 43 of the control rod 40. Thereafter, the thrust bearing 73 is forced to move toward the sleeve 61 before fitting another one (second) of the two thrust bearings 73. Finally, the fastening sleeve 71 is fastened to the sleeve 61 so as to force the second thrust bearing 73 to move close to the locating member 72, which is then confined by the two thrust bearings 73. As a result, the control rod 40 can be caused to turn but can not be caused to move axially.

As shown in FIG. 9, the vise described above is suitable for use in holding and locating the work piece concentrically. In other words, the center of a cylindrical work piece of any diameter can be located rapidly and precisely by the vise of the present invention.

Figure 10:
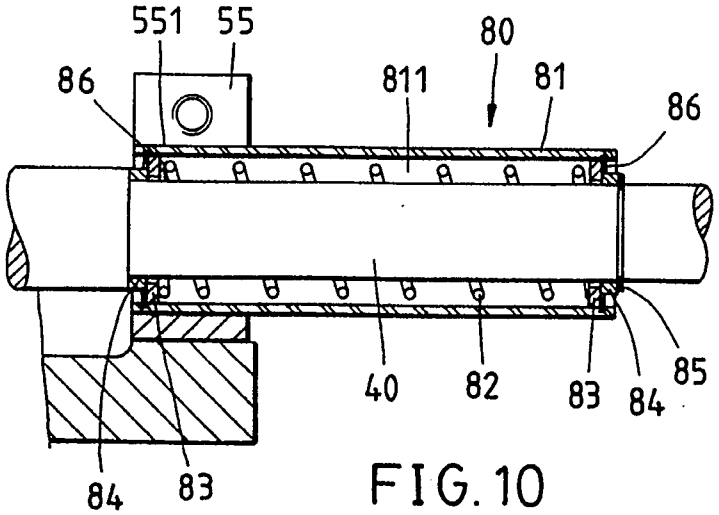
FIG. 10 shows a schematic view of another embodiment of the tolerance compensating device of the present invention.

As shown in FIG. 10, another tolerance compensating device 80 embodied in the present invention comprises the following component parts.

A sleeve 81 is fitted into the through hole 551 of the locking block 55. The inner wall surface of the sleeve 81 is devoid of any arresting means attached thereto. The sleeve 81 has an axial hole 811 dimensioned to receive therein the control rod 40.

An elastic element 82 is disposed in the sleeve 81.

Two washers 83 are fitted around the control rod 40 and are located respectively at both ends of the elastic element 82.

Two end thrust members 84, which are in fact two thrust bearings, are fitted over the control rod 40 and are respectively adjacent to the two washers 83. The two end thrust members 84 are retained respectively by means of two C-shaped retaining rings 85.

Two arresting members 86, which are in fact two C-shaped retaining rings, are fastened respectively to the inner wall of both ends of the sleeve 81 for preventing the two washers 83 from slipping out of the sleeve 81. The constructions of the two arresting members 86 are such that they do not obstruct the two end thrust members 84.

The functions of the tolerance compensating device 80 are similar to those of the tolerance compensating device 60 and will not be therefore described further. It must be noted here that the tolerance compensating device 80 can be used in conjunction with the fastening device 70.

What is claimed is:

1. A vise with interchangeable double clamping seat or single clamping seat comprising:

a main seat of rectangular construction and provided with a slot of an inverted T-shaped constructions along a central axis;

two movable jaws mounted on said main seat;

two transmission blocks coupled respectively with said two movable jaws such that said two transmission blocks are suspended in said slot of said main seat, said two transmission blocks having concentrically two threaded holes identical in thread pitch but opposite in threading direction;

a control rod provided with two threaded segments engageable with said two threaded holes of said two transmission blocks and received in said slot of said main seat such that one end of said control rod is disposed outside said main seat for driving said two transmission block which in turn actuate said two movable jaws to move synchronously in opposite directions; and a fixing jaw mounted detachably on said main seat such that said fixing jaw and said two movable jaws form together a double clasping seat;

wherein one end of said control rod is provided with a tolerance compensating device comprising:

a sleeve fitted over said one end of said control rod and fastened to said main seat;

two end thrust members mounted on said control rod such that said two end thrust members are adjacent to two open ends of said sleeve; and at least one elastic element disposed between said sleeve and said control rod for providing a resistance to said control rod moving axially, wherein said elastic element and each of said thrust members are provided therebetween a slide member to reduce the mechanical friction between said elastic element and said each of said two end thrust members at the time when said control rod is caused to turn.

2. The vise of claim 1 wherein said slide member is a bearing.

3. The vise of claim 1 wherein said elastic element of said tolerance compensating device is provided respectively at both ends thereof with a washer fitted over said control rod such that said washer can be caused to move axially by said elastic element so as to be retained in an inner side of said two end thrust members; and wherein said two open ends of said sleeve are provided respectively on an inner wall thereof with an arresting member for preventing said washer from slipping accidentally out of said sleeve, said arresting member being of a construction permitting each of said two end thrust members to pass therethrough.

4. The vise of claim 1 wherein said main seat is provided with a locking block having centrally a through hole and having in one side thereof a guide slot and further having a threaded hole perpendicular to said guide slot; wherein said locking element is a bolt engageable with said threaded hole of said locking block; and wherein said sleeve of said tolerance compensating device is fitted into said through hole of said locking block, 5. The vise of claim 1 wherein said fastening device comprises: a fastening sleeve having one end fastened to said sleeve and another end provided with a hole dimensioned to receive therein said control rod; a locating member fastened to said control rod and disposed in said fastening sleeve; and two thrust bearings located respectively at both sides of said locating member and disposed respectively in said fastening sleeve for confining said locating member so as to regulate said control rod to turn without moving axially.

6. The vise of claim 5 wherein said fastening sleeve is fitted over said sleeve; and wherein said locating member is a nut engageable with said control rod without making contact with said fastening sleeve.

7. A vise with interchangeable double clamping seat or single clamping seat comprising:

a main seat of rectangular construction and provided with a slot of an inverted T-shaped construction along a central axis;

two movable jaws mounted on said main seat;

two transmission blocks coupled respectively with said two movable jaws such that said two transmission blocks are suspended in said slot of said main seat, said two transmission blocks having concentrically two threaded holes identical in thread pitch but opposite in threading direction;

a control rod provided with two threaded segments engageable with said two threaded holes of said two transmission blocks and received in said slot of said main seat such that one end of said control rod is disposed outside said main seat for driving said two transmission blocks which in turn actuate said two movable jaws to move synchronously in opposite directions; and a fixing jaw mounted detachably on said main seat such that said fixing jaw and said two movable jaws form together a double clasping seat;

wherein one end of said control rod is provided with a tolerance compensating device comprising:

a sleeve fitted over said one end of said control rod and fastened to said main seat;

two end thrust members mounted on said control rod such that said two end thrust members are adjacent to two open ends of said sleeve; and at least one elastic element disposed between said sleeve and said control rod for providing a resistance to said control rod moving axially, wherein said fixing jaw can be removed from said main seat so as to convert said double clamping seat into single clamping seat; and wherein said tolerance compensating device and said control rod are provided therebetween with a fastening device which regulates said control rod to turn without moving axially.

8. The vise of claim 7 wherein said sleeve of said tolerance compensating device has an inner wall provided centrally with a protruded arresting portion provided at both ends thereof with an elastic element; and wherein said two end thrust members of said tolerance compensating device are adjacent respectively to said elastic element provided at each of said both ends of said arresting portion, with each of said two end thrust members intended to compress said elastic element.

9. The vise of claim 7 wherein said main seat is provided with a through hole dimensioned to receive therein adjustably said sleeve of said tolerance compensating device, with said sleeve being located by a locking element.

* * * * *